US005819131A

United States Patent [19]

Kim

[11] Patent Number: 5,819,131

[45] Date of Patent: Oct. 6, 1998

[54] TECHNIQUE FOR CONTROLLING THE DEVELOPING VOLTAGE TO ACCOMODATE THE ENVIRONMENT

[75] Inventor: Sun-Jin Kim, Pyeongtaek, Rep. of Korea

[73] Assignee: SamSung Electronics Co., Ltd., Suwon, Rep. of Korea

[21] Appl. No.: 861,691

[22] Filed: May 22, 1997

[30] Foreign Application Priority Data

May 22, 1996 [KR] Rep. of Korea ..... 1996-17532

[51] Int. Cl.[6] ..... G03G 15/00

[52] U.S. Cl. ..... 399/44; 399/55

[58] Field of Search ..... 399/44, 55

[56] References Cited

U.S. PATENT DOCUMENTS 4,314,755 2/1982 Kinashi .
5,029,314 7/1991 Katsumi et al. .
5,034,772 7/1991 Suzuki .
5,084,737 1/1992 Hagan et al. .
5,128,717 7/1992 Uchikawa et al. .
5,138,379 8/1992 Kanazashi .
5,148,218 9/1992 Nakane et al. .
5,170,210 12/1992 Saruwatari .
5,183,964 2/1993 Slelter et al. .
5,214,477 5/1993 Hirobe et al. ..... 399/27
5,276,483 1/1994 Hasegawa et al. .
5,291,253 3/1994 Kumasaka et al. .
5,371,579 12/1994 Bisaiji .
5,465,135 11/1995 Nakagama et al. .
5,579,091 11/1996 Yamada et al. .

FOREIGN PATENT DOCUMENTS 58-173762 10/1983 Japan .

*Primary Examiner*—Joan H. Pendegrass
*Attorney, Agent, or Firm*—Robert E. Bushnell, Esq.

[57] ABSTRACT

A technique for controlling the developing voltage of an electrophotographic apparatus to accommodate environmental conditions includes: measuring the developing current varying with environmental conditions, and adjusting the high voltage supplied to the developer according to the measured developing current.

5 Claims, 3 Drawing Sheets

TECHNIQUE FOR CONTROLLING THE DEVELOPING VOLTAGE TO ACCOMODATE THE ENVIRONMENT

CLAIM OF PRIORITY

This application makes reference to, incorporates the same herein, and claims all benefits accruing under 35 U.S.C. §119 from an application for DEVICE FOR CONTROLLING THE DEVELOPING VOLTAGE TO ACCOMMODATE TO ENVIRONMENT AND METHOD THEREFOR earlier filed in the Korean Industrial Property Office on the 22$^{th}$ day of May 1996 and there duly assigned Ser. No. 17532/1996, a copy of which application is annexed hereto.

BACKGROUND OF THE INVENTION

1. Field of the Invention

The present invention relates to an electrophotographic apparatus, and particularly a technique for controlling the developing voltage to accommodate the atmospheric environment.

2. Description of the Related Art

Generally, electrophotography is widely used for copy machines, "plain paper" facsimile machines, laser printers, etc. It is well known that electrophotography comprises the steps of charging, exposing, developing, transferring the toned image to the paper, and thermal fusing of the toner to the paper.

In the charging process, the photoconductive drum is charged by an electrostatic charging device so as to create a uniform area charge on the surface of the photoconductive drum. In the exposing process, the photoconductive drum is exposed to the image light pattern corresponding to an original copy or image data to create a latent image on the photoconductive drum. In the developing process, the developing agent (the electrostatically charged toner) is applied onto the photoconductive drum so as to adhere to the electrostatic image created on the surface of the photoconductive drum. In the transferring process, the toner image created on the photoconductive drum is transferred to the transfer paper. In order to perform the above steps of charging, exposing, developing, transferring processes, a high voltage bias power source is needed.

Accordingly, electrophotographic apparatus set its high voltage bias power supply so as to be capable of obtaining the optimum image quality under a normal temperature and humidity. When the temperature and/or humidity is changed, the high voltage bias power supply is maintained uniformly, while the physical properties of the constituent elements of the image developing device are changed. Particularly, the adhesiveness of the developing agent used becomes degraded as the humidity is increased, and accordingly, the quantity of the developing agent adhered to the charged roll is insufficient, resulting in a deterioration of the developing quality. Hence, the quantity of the toner (developing agent) fused to the transfer paper is decreased, deteriorating the transferred image quality.

On the other hand, the adhesiveness of the developing agent is increased when the humidity is decreased. Accordingly, an excessive amount of the developing agent is adhered to the charged roll, increasing the quantity of the developing agent transferred to the transfer paper excessively. In this case, ghost images may be produced. Further, if all the developing agent adhered to the charged roll isn't transferred to the paper, the charged roll becomes contaminated due to the residual developing agent.

As mentioned above, the earlier electrophotographic apparatus can supply the optimum development voltage based on the normal temperature and humidity to the developer roll, but has a drawback in that the image quality is deteriorated when the atmospheric conditions are changed.

The Hagen el al. patent, U.S. Pat. No. 5,084,737, entitled Image Transfer Method And Apparatus Wherein The Application Of The Transfer Bias Is Delayed As A function Of Humidity, discloses an image transfer arrangement in which the transfer field is delayed as a function of the resistance of the drum which varies with environmental conditions. However, Hagen et al. '737 does not teach or suggest varying the transfer voltage in accordance with the environmental conditions.

The Hasegawa patent, U.S. Pat. No. 5,276,483, entitled Image Forming Apparatus Provided With An Attraction Charger Controlled By One Or More Ambient Conditions, discloses an apparatus in which the attraction means and transfer means are controlled in accordance with environmental conditions.

The Kumasaka et al. patent, U.S. Pat. No. 5,291,253, entitled Corona Deterioration And Moisture Compensation For Transfer Unit In An Electrophotographic Apparatus, discloses an electrophotographic apparatus in which the resistance used of a transfer belt and recording paper are measured and the current value applied to a device for charging a member is set on the basis of the measured resistance values which vary with environmental conditions.

The Bisaiji patent, U.S. Pat. No. 5,371,579, entitled Pretransfer Charging Device For Image Forming Equipment, discloses an apparatus in which the output of a pretransfer charger is controlled in response to environmental sensor.

The Uchikawa et al. patent, U.S. Pat. No. 5,128,717, entitled Image Forming Apparatus, discloses an image forming apparatus in which the output of a transfer charging device is varied in accordance with environmental conditions.

The Kinashi patent, U.S. Pat. No. 4,314,755, entitled Bias Voltage Controlled Developing System In An Electrophotographic Copying Machine, discloses an apparatus in which the bias voltage is varied in accordance with a measured humidity value.

The following patents each disclose features in common with the present invention but are not believed to be as pertinent as the patents discussed in detail above: U.S. Pat. No. 5,579,091 to Yamada et al., entitled Developing Unit For Electro-Photographic Apparatus, U.S. Pat. No. 5,465,135 to Nakagama et al., entitled Charger Control In An Electrophotographic Copying Apparatus, U.S. Pat. No. 5,138,379 to Kanazashi, entitled Image Forming Apparatus Having Temperature And Humidity Detecting Means, U.S. Pat. No. 5,148,218 to Nakane et al., entitled Image Forming Apparatus With A Humidity Detector, U.S. Pat. No. 5,183,964 to Stelter et al., entitled toner Charge Control, U.S. Pat. No. 5,170,210 to Saruwatari, entitled Image Forming Apparatus Having Environmental Detecting Means For Achieving Optimum Image Density, U.S. Pat. No. 5,029,314 to Katsurni et al., entitled Image Formation Condition Controlling Apparatus Based On Fuzzy Inference, and U.S. Pat. No. 5,034,772 to Suzuki, entitled Humidity Measurement Device And Image Forming Apparatus Having The Same.

SUMMARY OF THE INVENTION

Accordingly, it is an object of the present invention to provide a development voltage control technique for adapting to the atmospheric environment by controlling the development voltage in response to the changes of atmospheric conditions.

According to the present invention, a technique for controlling the developing voltage of an electrophotographic apparatus to accommodate the environment, comprises measuring the developing current varying with environment, and adjusting the high voltage applied to the developer according to the measured developing current.

The present invention will now be described more specifically with reference to the drawings attached only by way of example.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE PREFERRED EMBODIMENT(S)

Figure 1:
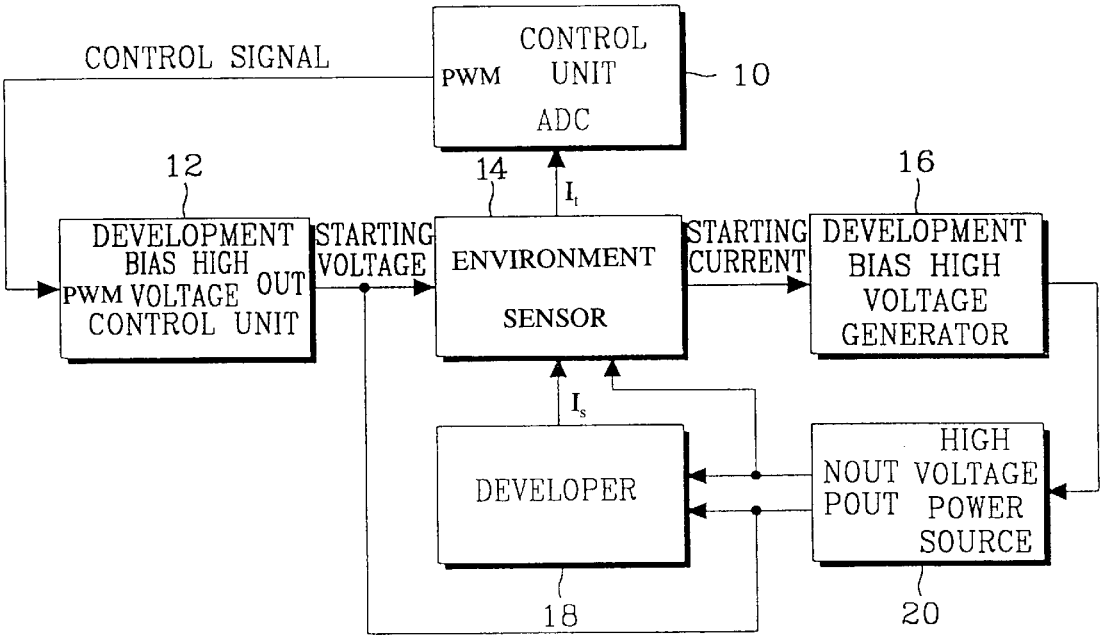
FIG. 1 is a block diagram illustrating the developing voltage control device accommodating to the atmospheric environment according to an embodiment of the present invention.

Referring to FIG. 1, the control unit 10 of the developing voltage control device outputs the control signal having a duty cycle of a specified ratio through the terminal PWM. The control signal is supplied to the terminal PWM of the development bias high voltage control unit 12. Upon receiving the control signal, the development bias high voltage control unit 12 outputs an appropriate voltage is corresponding to the duty cycle of the control signal from the output terminal OUT. The voltage output from the above output terminal OUT is termed the "starting voltage". Namely, the greater the duty cycle, the higher the starting voltage, and conversely, the smaller the duty cycle, the lower the starting voltage.

The starting voltage is supplied to the environment sensor 14, which in turn transmits the starting signal for starting the developing bias to the development bias high voltage generator 16 when the starting voltage is higher than the specified voltage. The development bias high voltage generator 16 starts the high voltage power source 20. Upon starting, the high voltage power source 20 outputs the development bias high voltage through the negative output terminal Nout and the positive output terminal Pout. The development bias high voltage is supplied to the developer 18, which performs the developing process upon receiving the development bias high voltage. The developer 18 outputs a sensing current Is by subjecting the high developing bias voltage to a resistance.

Accordingly, the environment sensor 14 receives the high voltage negative output and the sensing current from the high voltage power source 20 and the developer 18 respectively to produce the output current It sensing the environment changes. The output current It is supplied to the control unit 10, which thereupon adjusts the duty cycle of the control signal. The control signal is further converted into the starting voltage corresponding to the duty cycle so as to be added to the positive output Pout of the high voltage power source 20, thereby changing the magnitude of the voltage. The voltage output from the positive output terminal Pout of the high voltage power source 20 is at negative potential, and the voltage output from the negative output terminal Nout of the high voltage power source 20 is at a very high negative potential.

Consequently, since the magnitude of the positive voltage of a minus sign(−) supplied to the developer 18 becomes more positive as the starting voltage increases to positive, the difference between said negative and positive voltages becomes greater to further increase the high voltage.

Figure 4:
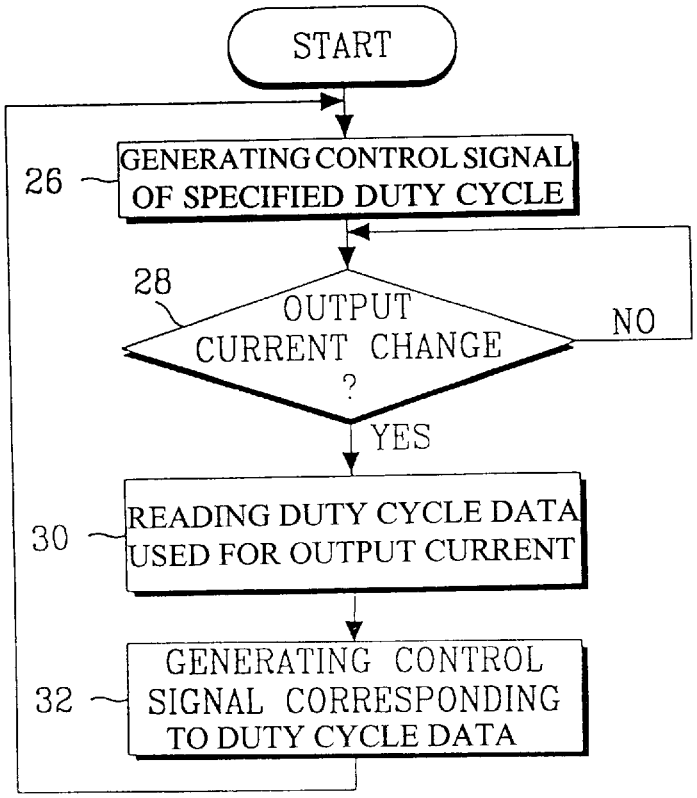
FIG. 4 is a flowchart illustrating the developing voltage control device accommodating the atmospheric environment according to an embodiment of the present invention.

Referring to FIG. 4, the control unit 10 performs step 26 when receiving a print command, outputting a control signal of a specified duty cycle. At this time, the development bias high voltage control unit 12 outputs the starting voltage corresponding to the duty cycle of the control signal to the environment sensor 14. When the starting voltage is supplied, the environment sensor 14 supplies the start signal to the development bias high voltage generator 16 to start the high voltage power source 20. The high voltage power source 20 supplies a high voltage to the developer 18. The developer 18 then supplies the environment sensor 14 with the sensing current Is fluctuating according to the atmospheric conditions. The environment sensor 14 supplies the output current It to the control unit 10.

At this time, the control unit 10 performs step 28 when receiving the output current It. In step 28, the control unit 10 checks whether the output current It is the same as the normal output current It produced under the normal temperature and humidity. If the existing output current It is not changed due to the unchanged atmospheric condition, being the same as the normal output current It corresponding to the normal temperature and humidity, the control unit 10 repeats step 28. On the contrary thereto, when the existing output current is changed due to a changed atmospheric condition, the control unit 10 performs step 30.

The control unit 10 has a memory which stores the data representing the duty cycle of the control signal for outputting the optimum development bias high voltage corresponding to the change of the atmospheric condition. The duty cycle data can be obtained by experiment.

In step 30, the control unit 10 retrieves the duty cycle data corresponding to the changed output current It from the memory, and proceeds to step 32. In step 32, the control unit 10 outputs the control signal corresponding to the duty cycle data. After outputting the control signal, the control unit 10 returns to step 26 to further repeat these steps.

The control signal produced by the control unit 10 is converted into the starting voltage to be supplied to the environment sensor 14. As mentioned above, the control unit 10 adjusts the voltage supplied to the developer 18 from the positive input terminal Pout of the high voltage power source 20. At this time, in order to increase the voltage of the developer 18, the duty cycle of the control signal is increased, and on the contrary thereto, in order to decrease the voltage of the developer 18, the duty cycle of the control signal is decreased.

The control unit 10 performs the above adaptation steps during a print operation. Accordingly, the optimum image quality is maintained, adapting to the environment changes during the print operation.

Figure 2:
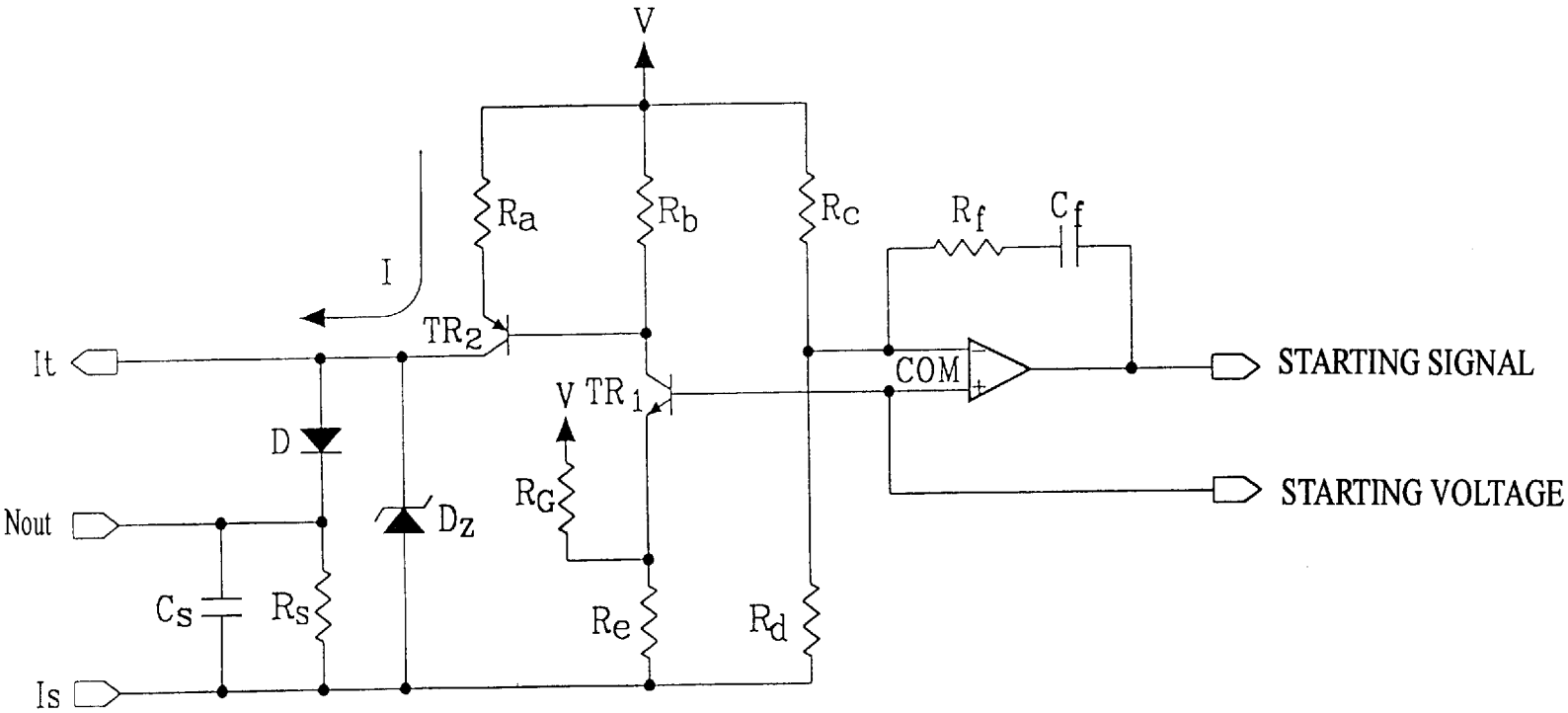
FIG. 2 is a detailed circuit diagram illustrating the environment sensor 14 as shown in FIG. 1.

Referring to FIG. 2, it is herewith explained in detail that the high voltage supplied to the environment sensor 14 and the developer 18 from the high voltage source 20, and the development bias high voltage is adjusted by the control unit 10.

The starting voltage is supplied to the non-inverting input terminal(+) of the comparator COM as depicted in FIG. 2. The inverting input terminal(−) of the comparator COM is supplied with a voltage divided by the resistors Rc and Rd. The divided voltage is termed a "reference voltage". When the starting voltage is smaller than the reference voltage, a high-state output is produced at the output terminal. The high-state, output is termed the "start signal". The start signal is supplied to the to development bias high voltage generator 16, which in turn generates a high voltage in response to the start signal so as to supply it to the developer 18.

Figure 3:
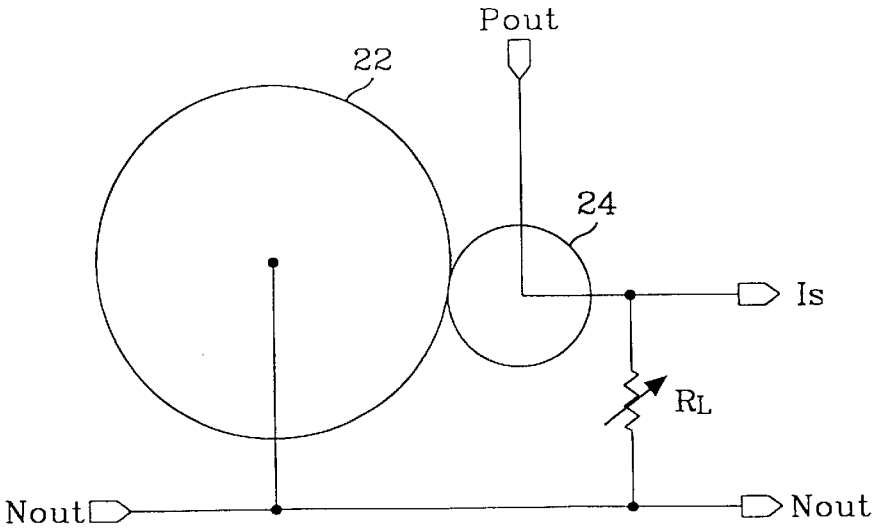
FIG. 3 is an circuit diagram illustrating the application of voltage to the developer 18.

Referring to FIG. 3, the development bias high voltage is applied to the developer 18. The high voltage is further output by means of the load resistor RL. The load resistor RL is affected by the environmental conditions, but the high voltage is not changed. Accordingly, when the load resistor RL is changed by/according to the environmental condition, the magnitude of the sensing, current Is output from the developer 18 is changed.

Namely, when the humidity is increased, the resistance value of the load resistor RL is decreased. Accordingly, since the quantity of the current flowing into the load resistor RL is increased, on the contrary, the quantity of the sensing current Is decreased. Besides, when the humidity is decreased, the resistance value of the load resistor RL is increased, whereby the quantity of the sensing current Is increased because the quantity of the current flowing into the load resistor RL is decreased.

Further, the sensing current Is flows into the sensing resistor Rs. The capacitance Cs connected in parallel to the sensing resistor Rs damps the noise mixed in the sensing current Is so as to secure a balanced sensing current Is.

In FIG. 2, the power supply voltage V is supplied to the collector of the transistor TR1 through the resistor Rb. The start voltage is supplied to the base of the transistor TR1. The collector of the transistor TR1 is connected to the base of the transistor TR2. Further, the power supply voltage V is supplied to the emitter of the transistor TR2 through the resistor Ra, and the collector of the transistor TR2 is connected to the anode of the diode D. The cathode of the diode D is connected to the sensing resistor Rs. The diode D is to protect the circuit from the noise and surge generated from the development bias high voltage generator 16. The control diode Dz connected between the ground and the anode of the diode D to protect the control unit 10 by preventing an overvoltage above the specified voltage from being supplied to the terminal of the control unit 10.

The start voltage is supplied to the base of the transistor TR1 to make the transistor TR2 conductive. When the transistor TR2 is conductive, the current I of the power supply voltage V flows through the resistor Ra and the transistor TR2. The current I flows quite uniformly owing to the time constants of the resistors Ra, Rb, Rg, Re.

As illustrated in FIG. 2, the output current It is generated by adding the sensing current Is and the current I. The output current It is changed only in response to the change of the sensing current Is because the current I is not changed. The output current It is supplied to the terminal ADC of the control unit 10. The control unit 10 can analyze the output current It to detect the electrical change according to the environment condition. Accordingly, the control unit 10 outputs the PWM signal having the duty cycle data for generating the optimum development bias high voltage corresponding to the electrical change. The information on the PWM having the duty cycle corresponding to the electrical change is obtained by experiment and stored in its memory in advance.

Thus, the high developing bias voltage can be adjusted to accommodate to the changes of the atmospheric conditions, whereby various problems resulting from the physical properties changes of the constituent elements of the equipment due to the changes of the atmospheric conditions can be removed, and particularly, the possible deterioration of the image quality due to the change of the adhesiveness of the developing agent can be minimized.

It should be understood that the present invention is not limited to the particular embodiment disclosed herein as the best mode contemplated for carrying out the present invention, but rather that the present invention is not limited to the specific embodiments described in this specification except as defined in the appended claims.

What is claimed is:

1. A method of controlling a developing voltage of an electrophotographic apparatus to accommodate environmental conditions, comprising the steps of:

measuring a developing current varying with environmental conditions; and adjusting a high voltage supplied to a developer according to said measured developing current;

further comprising the steps of:

supplying a control signal having a specified duty cycle to a circuit for supplying a voltage to said developer;

checking whether an output current of said developer is the same as an output current during normal temperature and humidity environmental conditions stored in a memory; and adjusting the magnitude of the voltage supplied to said developer to accommodate changes in the output current of said developer.

2. A method of controlling a developing voltage of an electrophotographic apparatus to accommodate environmental conditions, comprising the steps of:

supplying a voltage to a developer by means of a control signal having a specified duty cycle;

checking whether an output current of said developer is the same as the output current corresponding to normal temperature and humidity environmental conditions stored in a memory; and adjusting the magnitude of the developing voltage of the developer according to changes of the output current of said developer when said output current is different from the output current during the normal temperature and humidity environmental conditions.

3. A method of controlling the developing voltage as defined in claim 2, further comprising the steps of:

converting said control signal into a control voltage corresponding to the duty cycle of said control signal;

supplying said control voltage to a control circuit of said developer; and supplying said control signal to a voltage source supplying said voltage to said developer.

4. A method of controlling the developing voltage as defined in claim 2, the step of adjusting the magnitude of the developing voltage further comprises the steps of changing the duty cycle of said control signal according to changes of the developing voltage, and supplying said control signal to said voltage source.

5. A device for controlling a developing voltage of an electrophotographic apparatus to accommodate to environmental conditions, comprising:

a control unit for adjusting a duty cycle of a control signal according to an environmental sensing current;

a development bias high voltage control unit for generating a starting voltage corresponding to the duty cycle of said control signal generated by said control unit;

a environment sensor for generating a starting signal in response to said starting voltage according to an environmental accommodation sensed signal;

a development bias high voltage generator for providing a developer with the developing voltage obtained by adding a high voltage and said starting voltage; and said developer for performing the developing process by said development bias high voltage and for generating said environmental accommodation sensed signal.

* * * * *